US005140831A

United States Patent [19]

Kohl et al.

[11] Patent Number: 5,140,831

[45] Date of Patent: * Aug. 25, 1992

[54] ICE MACHINE

[75] Inventors: Vance L. Kohl, Ladysmith; Joseph R. Spinner, Manitowoc, both of Wis.

[73] Assignee: The Manitowoc Company, Inc., Manitowoc, Wis.

[ * ] Notice: The portion of the term of this patent subsequent to May 14, 2008 has been disclaimed.

[21] Appl. No.: 694,645

[22] Filed: May 2, 1991

Related U.S. Application Data

[63] Continuation-in-part of Ser. No. 563,099, Aug. 3, 1990, Pat. No. 5,014,523.

[51] Int. Cl.[5] ..... F25C 1/12

[52] U.S. Cl. ..... 62/347; 62/352

[58] Field of Search ..... 62/72, 73, 347, 348, 62/352

[56] References Cited

U.S. PATENT DOCUMENTS

| | | | |
|---|---|---|---|
| 1,528,043 | 3/1925 | Bennett | 62/345 |
| 1,742,194 | 1/1930 | Bennett | 62/345 |
| 1,857,122 | 5/1932 | Sherman | 62/345 |
| 1,999,108 | 4/1935 | Osuch | 62/345 |
| 2,026,214 | 12/1935 | Chilton | 62/345 |
| 2,142,386 | 1/1939 | Tietz | 62/345 |
| 2,602,304 | 7/1952 | Randell | 62/345 |
| 2,616,271 | 11/1952 | Knowles | 62/345 |
| 2,803,950 | 8/1957 | Bayston | 62/345 |
| 3,159,011 | 12/1964 | Kaluzny et al. | 62/345 |
| 3,199,309 | 8/1965 | Brubaker | 62/345 |
| 3,253,425 | 5/1966 | McKissick | 62/345 |
| 3,309,892 | 3/1967 | O'Connell et al. | 62/345 |
| 3,580,007 | 5/1971 | Bauerlein | 62/345 |
| 3,762,181 | 10/1973 | Leidig | 62/320 |
| 4,354,360 | 10/1982 | Fiske | 62/320 |
| 4,845,955 | 7/1989 | Taylor | 62/71 |
| 4,898,002 | 2/1990 | Taylor | 62/71 |
| 5,014,523 | 5/1991 | Kohl | 62/347 |

FOREIGN PATENT DOCUMENTS

| | | |
|---|---|---|
| 754253 | 1/1931 | France . |
| 2491600 | 4/1982 | France . |

*Primary Examiner*—William E. Tapolcai
*Attorney, Agent, or Firm*—Leydig, Voit & Mayer

[57] ABSTRACT

An ice cube making machine having an inclined ice forming mold over which water is circulated from an underlying sump. The ice forming mold includes an endless, inclined conveyor for delivering the formed ice upwardly to an adjacent, laterally spaced ice storage bin.

9 Claims, 7 Drawing Sheets

ICE MACHINE

RELATED APPLICATION

This application is a continuation-in-part of U.S. patent application Ser. No. 07/563,099, filed Aug. 3, 1990, which issued on May 14, 1991, as U.S. Pat. No. 5,014,523.

FIELD OF THE INVENTION

The present invention relates to an ice making mechanism and, more particularly, to an ice machine having a compact ice forming mold and harvesting conveyor system.

BACKGROUND OF THE INVENTION

Ice making systems that provide ice for fountain-dispensed soft drinks should produce either small ice cubes or ice chips. Ice in these forms is easier to handle and store than larger ice cubes, and is more economical to produce than crushed ice, which is usually composed of smaller particles.

In designing an ice machine for producing small ice cubes or ice chips, it is desirable that the machine be energy efficient and mechanically simple, while at the same time providing high output capacity. In many applications, it is also desirable that the machine be compact. When, for example, the ice machine is to be installed under a serving counter, as in a restaurant or lounge, the free height available must house the evaporator, condenser, compressor, ice machine and storage bin. In addition, the level of ice in the storage bin must be kept relatively high, so that the ice is easily accessible.

Many commercial ice machines locate the evaporator and ice mold above the ice storage bin, since the ice is usually harvested and directed to the storage bin by gravity. For this reason, the storage bin is generally located at a position directly below the lowermost portion of the evaporator or ice forming mold. Such an arrangement, while well suited for use in hotels and commercial kitchens, is not readily adaptable for use in compact spaces, such as those under a serving counter, since the combined height of the storage bin and the evaporator results in a machine that is too tall for these applications.

OBJECTS AND SUMMARY OF THE INVENTION

It is, therefore, an object of the present invention to provide an ice machine which is compact and will fit beneath a serving counter. A related object is the provision of an ice machine in which the ice storage bin is readily accessible.

A more specific object of the invention is to provide an ice machine with a compact ice forming and harvesting mechanism which is capable of producing large quantities of clear ice. A related object of the invention is to provide a mechanism for making cubed ice wherein the ice cubes are well formed, frozen and maintain good form and shape when delivered to the ice storage bin.

In accordance with the present invention, these objects are realized by the provision of an ice forming mechanism which incorporates an endless conveyor for delivering the formed ice upwardly to an adjacent ice storage bin. The limited height requirements of an ice machine that can fit beneath a serving counter are met by inclining the ice forming mechanism to reduce the vertical height of the ice forming mold. Other objects and advantages of the invention will become apparent upon studying the following description and upon reference to the accompanying drawings.

While the invention will be described in connection with a preferred embodiment, it will be understood that contrary, we intend to cover all alternatives, modifications and equivalents as may be included within the spirit and scope of the invention as defined by the appended claims.

DESCRIPTION OF THE PREFERRED EMBODIMENTS OF THE INVENTION

Figure 1:
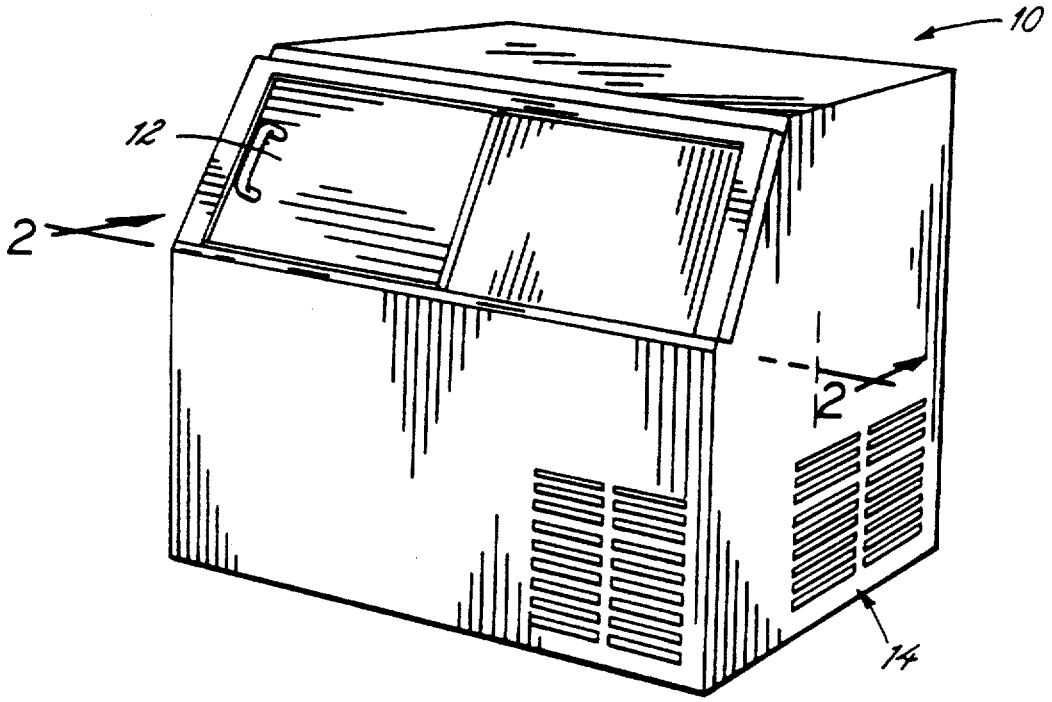
FIG. 1 is a perspective view of the ice machine of the present invention.

FIG. 1 illustrates the design of an ice machine 10 which incorporates the present invention. The machine is sized to fit beneath a serving counter, and includes an ice storage bin, which is accessible by opening door 12. The compressor and condenser of the machine 10 are enclosed in the lower section 14 thereof, as illustrated generally in FIGS. 2 and 3.

Figure 2:
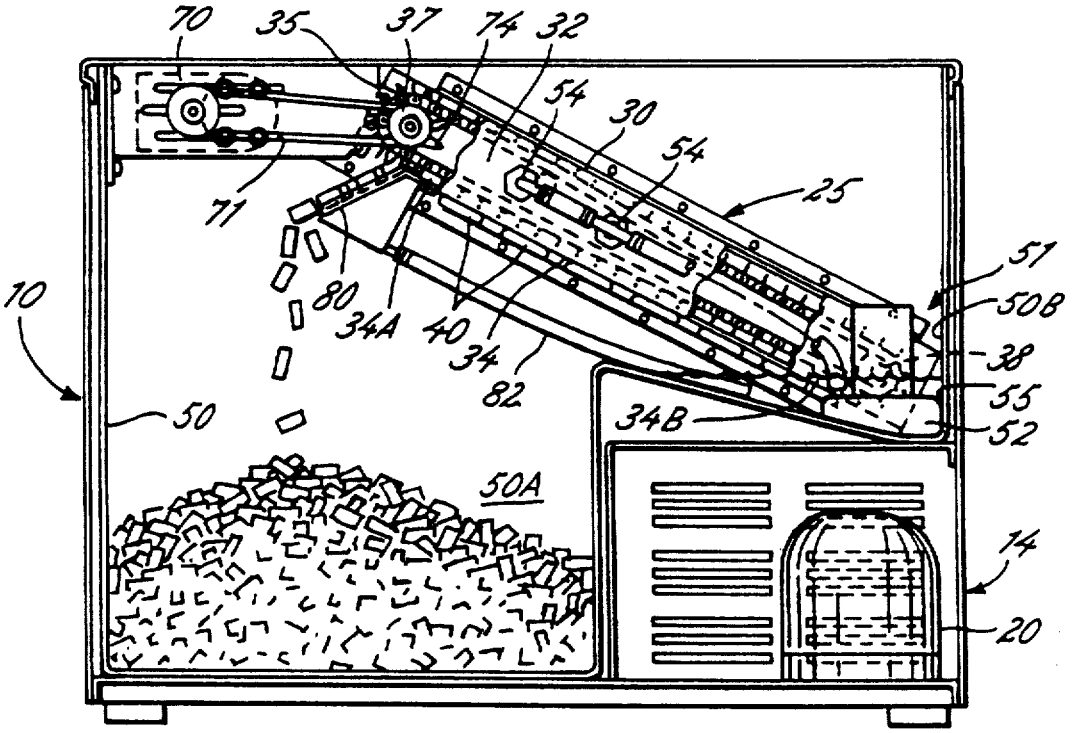
FIG. 2 is a front elevational cross section of the ice machine of the present invention taken along plane 2—2 of FIG. 1.
Figure 3:
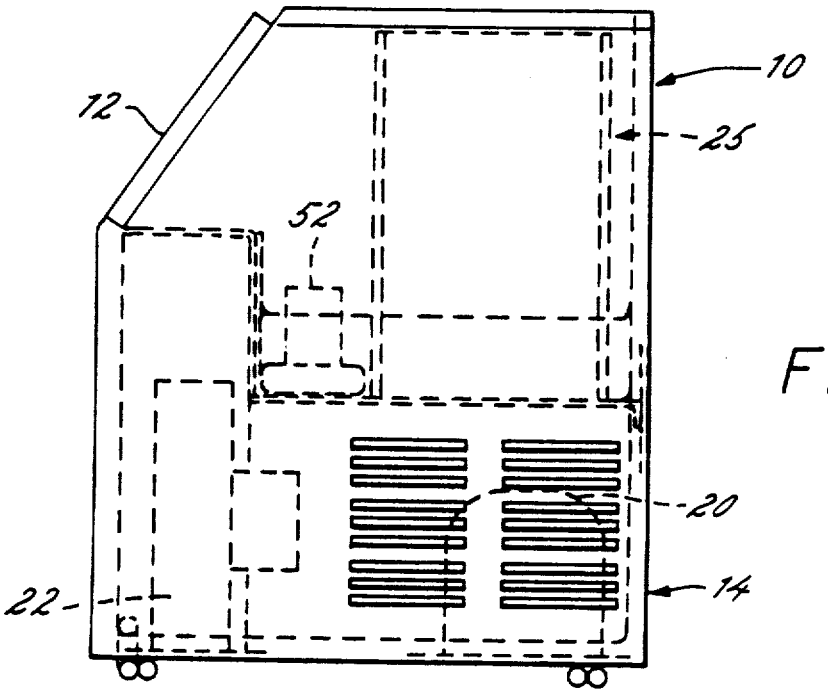
FIG. 3 is a vertical front-to-back view of the ice making machine showing the relative locations of the compressor, the condenser, the water pump and the ice forming and harvesting mechanism.
Figure 5:
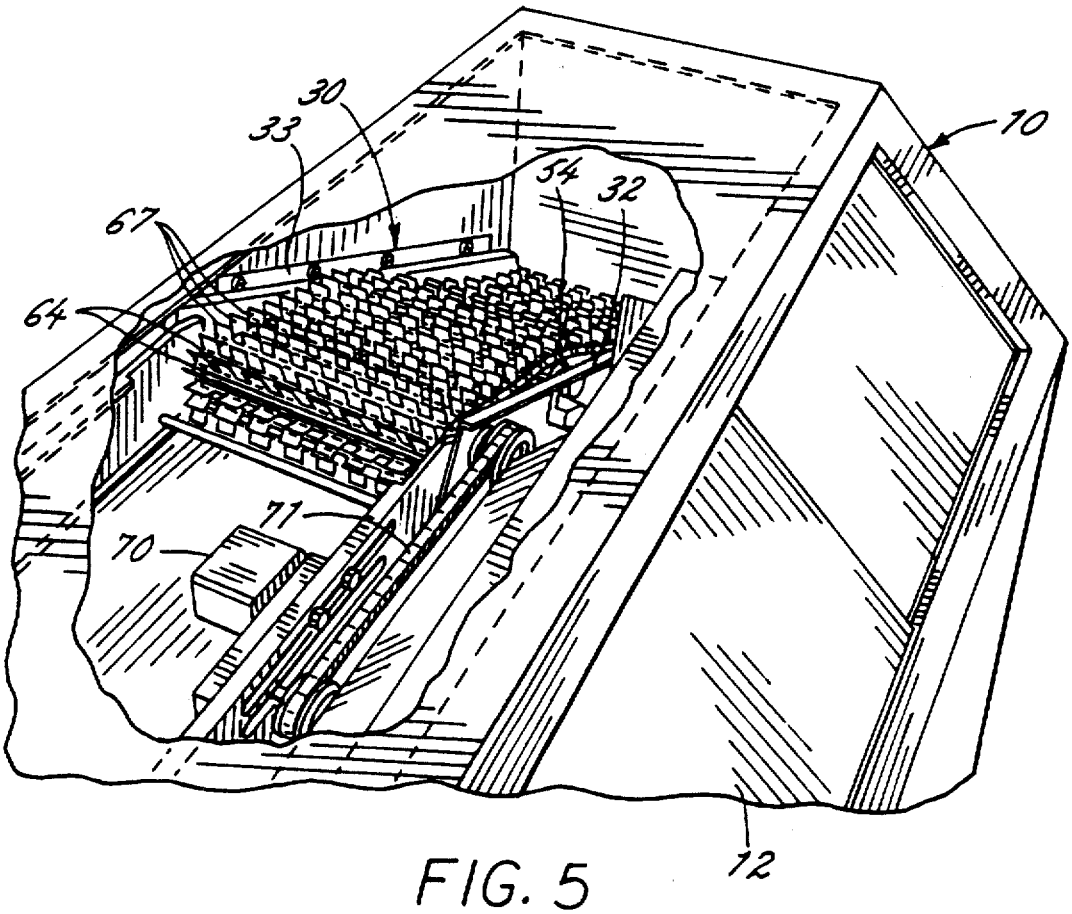
FIG. 5 is a perspective view of the ice machine of the present invention with portions cut away for clarity.
Figure 4:
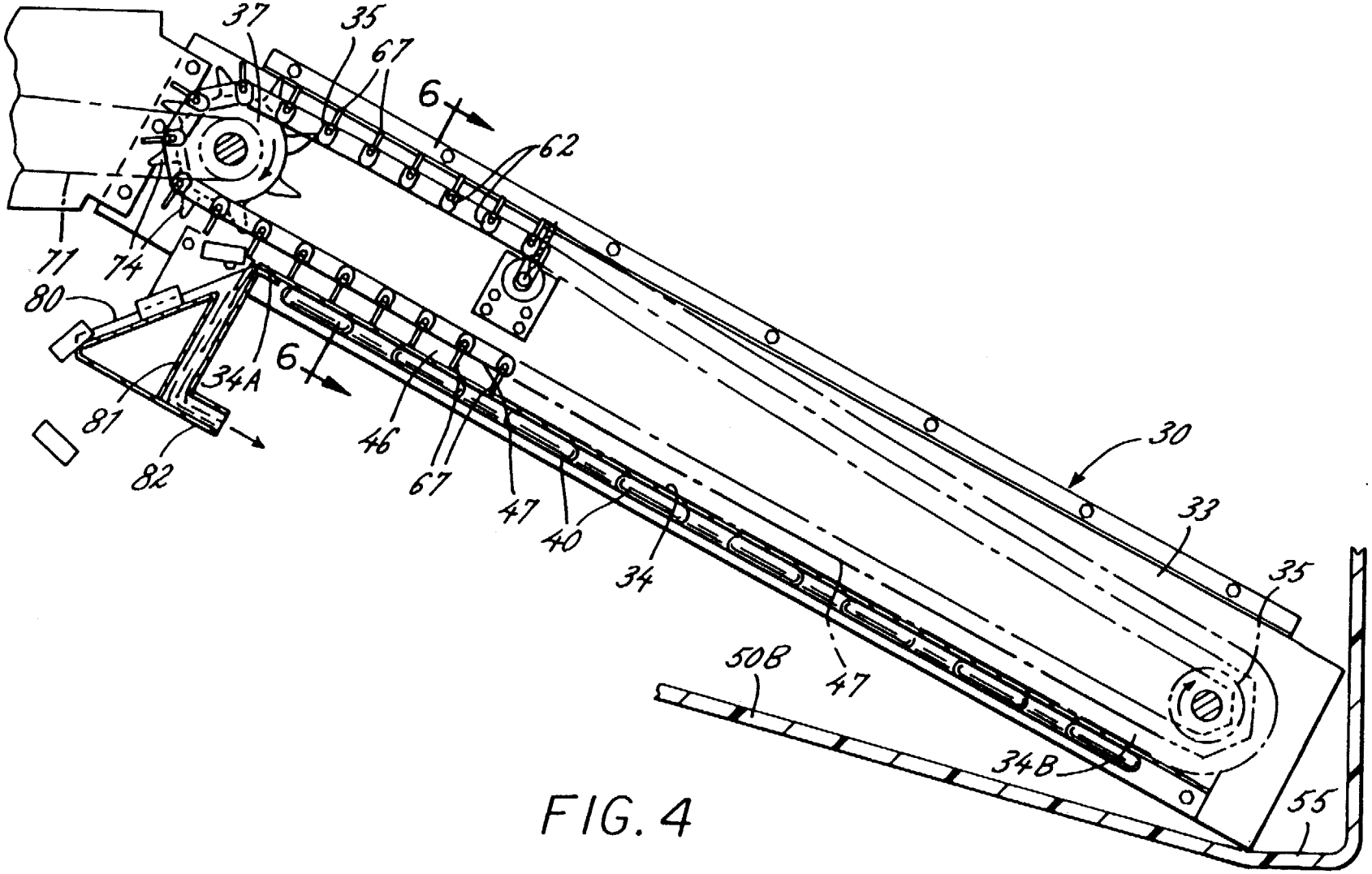
FIG. 4 is a side elevational view of the ice-forming and harvesting mechanism of the present invention.

The refrigeration apparatus, as shown in FIGS. 2 and 3, includes a compressor 20, a condenser 22, and an ice cube freezing and harvesting mechanism 25, which is also shown in FIGS. 4 and 5. The ice cube freezing an harvesting mechanism 25 includes a structure denoted generally as 30 having first and second side walls 32, 33 and a supporting member 34 on which the ice is formed.

The supporting member 34 has top and bottom portions 34A and 34B, respectively, the top portion 34A being disposed vertically above the bottom portion 34B. An endless inclined conveyor 35 translates about first and second pulleys or wheels 37, 38, which reverse the direction of the conveyor. The evaporator coils 40 are placed in close thermal contact with the supporting member 34, on the underside thereof. An ice forming chamber 46 is thus defined by the upper surface of the supporting member 34 and surface line 47, and is bounded on the sides thereof by first and second side walls 32, 33. The ice forming chamber 46 defines an ice forming mold and is divided into cube cells 49 as will be described in greater detail below.

The orientation of the ice cube freezing and harvesting mechanism 25 within the ice machine 10 is shown most clearly in FIGS. 2 and 5. The mechanism 25 is disposed within a tub-like structure 50 having a first ice cube storage portion 50A and a second portion 50B which underlies the bottom portion 34B of the supporting member 34 and which functions as a sump in the water recirculation system. The mechanism 25 is inclined upwardly from right to left as shown in FIG. 2 to minimize the height of the ice machine 10 and to position the top portion 34A of the supporting member 34 above the ice storage portion 50A of the tub-like structure 50. When positioned in this way, the harvested ice falls directly from mechanism 25 into the ice storage bin. Those skilled in this art will appreciate that the disposition of the ice cube freezing and harvesting mechanism 25 in an integral tub-like structure 50 permits the storage bin and the sump to be readily cleaned, and facilitates easy access to the ice cube freezing and harvesting mechanism 25.

A preferred embodiment of the ice making system of the present invention is shown in more detail in FIGS. 4 and 5. The ice making system includes a water recirculation system 51, including a recirculating pump 52 connected to headers or fountains 54, at least one of which is preferably located above the ice forming chamber 46. Each header 54 has an even distribution of holes along one side from which water flows at an even and controlled rate over the top of the mold and into cube cells 49. In accordance with the invention, water flows downwardly through the ice forming chamber 46, and is collected in sump 55 formed in the second portion 50B of tub-like structure 50.

The level of water, and hence the quantity of water in sump 55 may be controlled by a float valve (not shown). Water, which is removed from the sump (such as by its formation into ice), may be made up from an outside source in a conventional manner through a supply line via a make up pipe. When the water level in the sump 55 has risen to a predetermined level, the float valve closes, thereby shutting off the supply of water to the sump. Water can be flushed from the sump via a dump valve (not shown) which can be opened by a control system, thereby preventing the build-up of solids in the sump which may occur during use. Make up water can be supplied to the sump continuously during the freezing cycle or, as described in more detail below, supplied to the sump only at the start of the ice making cycle.

In accordance with the present invention, the conveyor 35 cooperates with the supporting member 34 to divide the ice forming chamber 46 into a plurality of cube cells 49. In keeping with this aspect of the invention, and as shown in the preferred embodiment of FIGS. 4, 5 and 8, the conveyor is preferably made up of an endless chain comprising links 62 which carry flights 64 in which fingers 67 are formed as shown most clearly in FIG. 8. The flights are preferably separated by a distance X, and the fingers are arranged to project outwardly therefrom. Together, the links, flights and fingers form the conveyor 35, and translate about first and second wheels 37 and 38.

Figure 6:
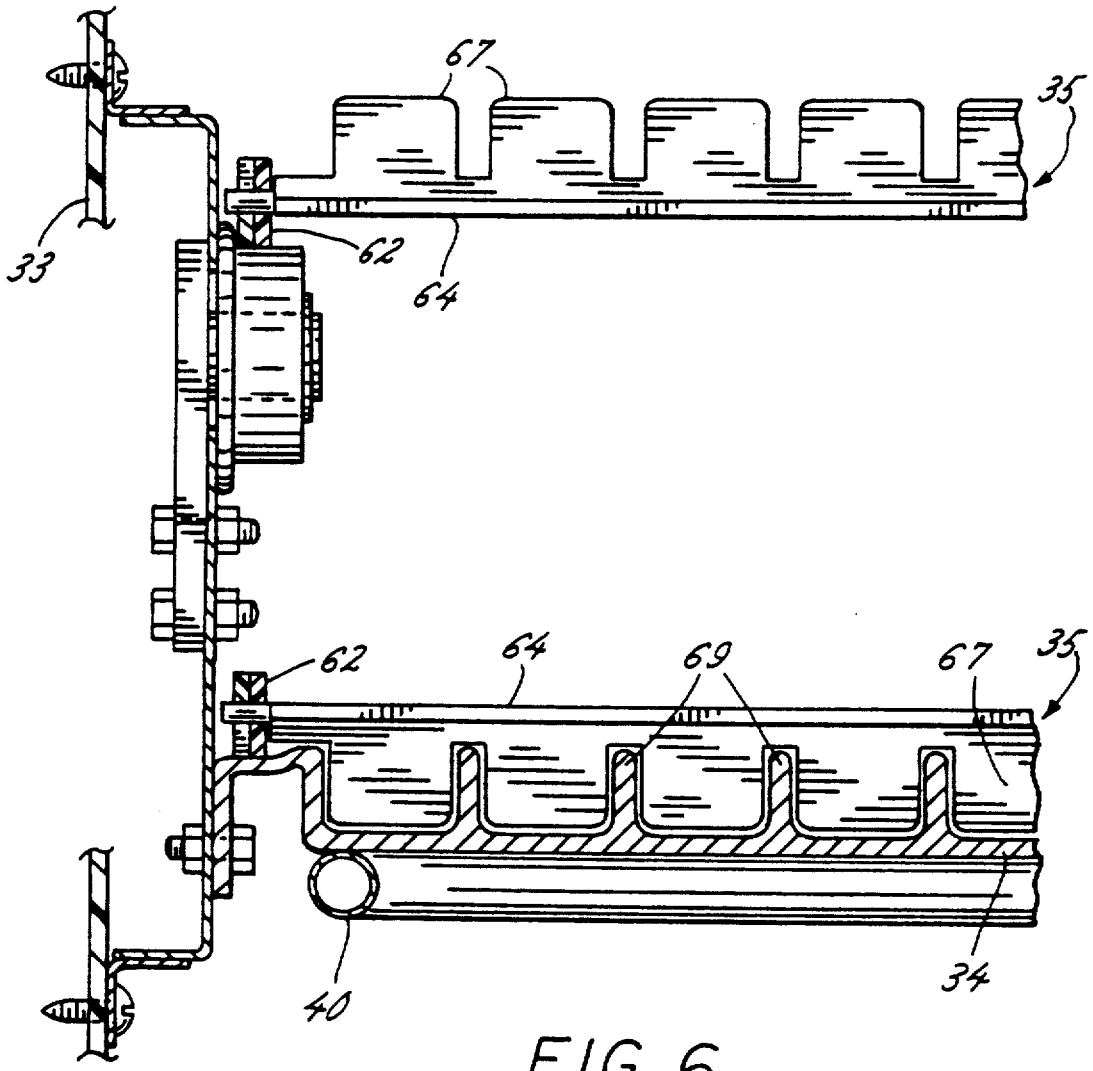
FIG. 6 is a cross-sectional view of the ice forming mechanism of the present invention taken along line 6—6 of FIG. 4.

As best shown in FIG. 6, a series of vertically oriented metallic vanes 69 project upwardly from supporting member 34. The vanes 69 are arranged in parallel spaced relation, and extend between fingers 67 from supporting member 34 to the flights 64. The vanes 69 thus cooperate with the flights 64 and fingers 67 to guide conveyor 35 as it moves through the ice forming chamber 46, and serve to define a close lattice structure comprising a plurality of ice forming cells 49. As those skilled in this art will appreciate, water delivered across the top of the lattice structure will flow downwardly through the freezing chamber, with portions thereof freezing in the cells of the lattice as the water trickles over the supporting member 34.

Figure 8:
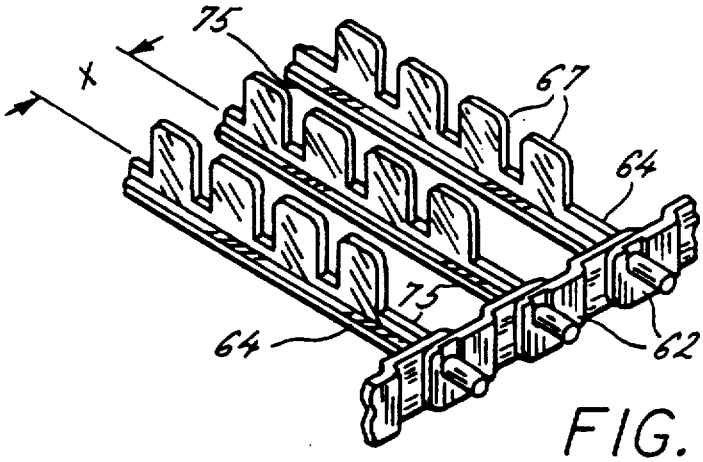
FIG. 8 is a perspective view of one embodiment of the conveyor of the present invention.

As best shown in FIG. 8, each finger 67 is spaced a predetermined distance from the adjacent finger By varying the distance between the fingers and the flights, one skilled in the art will appreciate that the cells 49 of ice machine 10 can be sized to produce cubes of different shapes and volumes.

As stated earlier, conveyor 35 rotates about first and second wheels 37 and 38. As shown in FIG. 2, second wheel 38 is preferably partially submerged in sump 55 so that the conveyor passes through the water to remove any ice or other solids adhered thereto.

Figure 7:
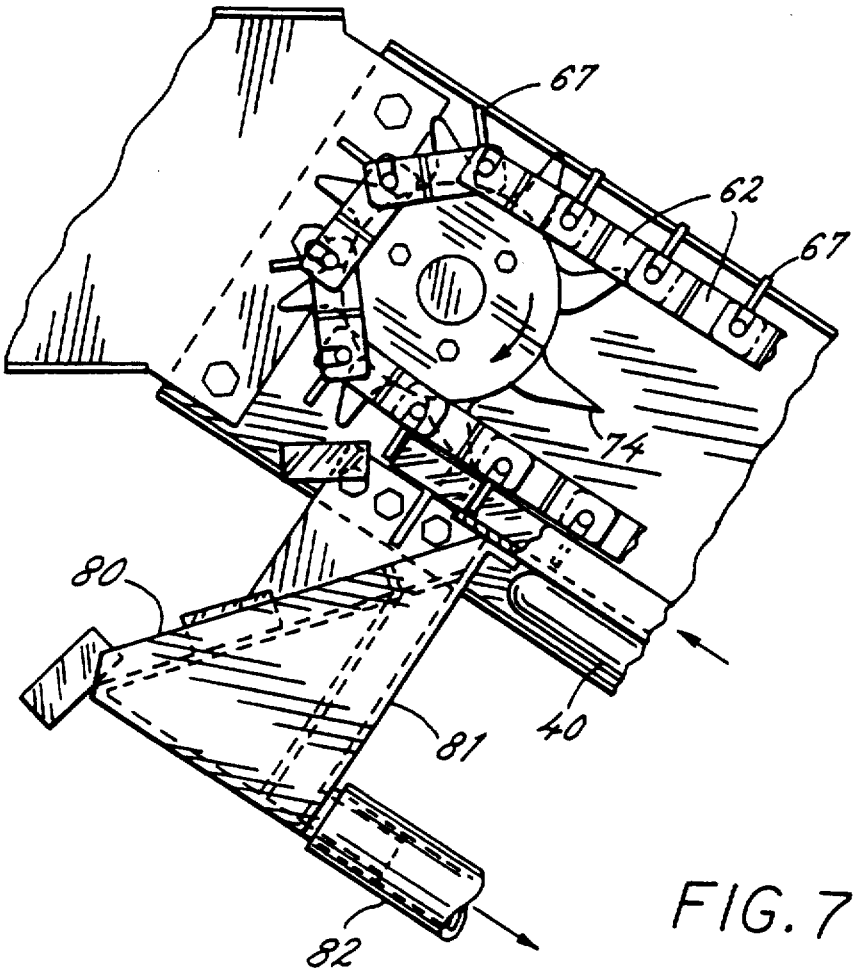
FIG. 7 is an elevational view of the harvesting pulley and inclined conveyor of the present invention.
Figure 9:
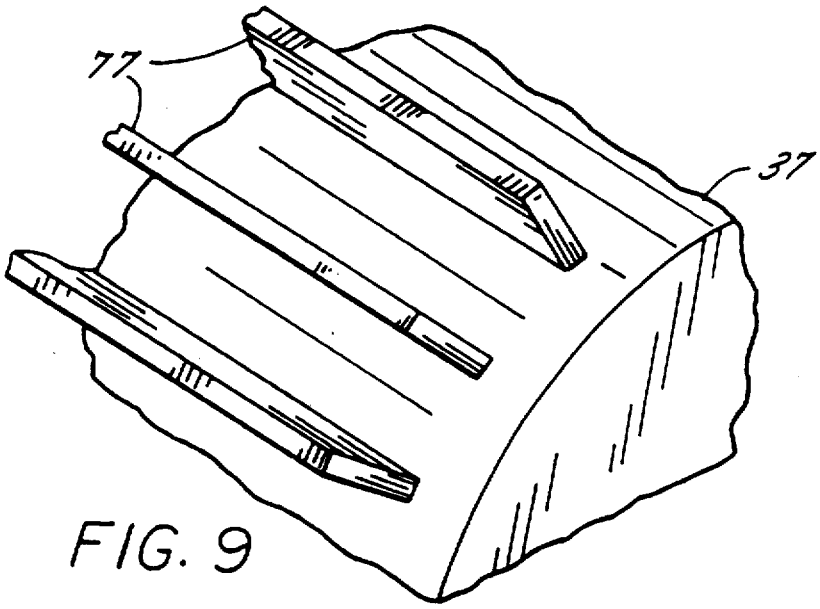
FIG. 9 is a perspective view of an alternative harvesting pulley useful with the conveyor shown in FIG. 8.

The first wheel 37 is driven by gear motor 70 and is coupled thereto by a drive belt 71. As best shown in FIG. 4, the first wheel 37 has a plurality of radially extending arcuate paddles 74 which are spaced to be in registration with the openings 75 in conveyor 35 defined by links 62 and flights 64. (See FIG. 7; FIG. 9 shows an alternative first wheel having straight paddles 77.) In accordance with one aspect of the invention, paddles 74 extend radially beyond the surface 76 of first wheel 37 a distance sufficient to loosen and harvest the formed ice which has adhered to the conveyor as the conveyor rotates about the first wheel 37. The harvested cubes are then directed by ramp 80 to the ice storage bin 50A as shown in FIG. 2. As shown most clearly in FIG. 7, water which may be carried upwardly by the conveyor during the harvest return line 82.

The refrigeration system is partially shown in FIGS. 2 and 3, with further details in FIGS. 4 and 5. As is well known to those skilled in this art, a liquid refrigerant is fed through a supply line through an expansion control valve and into evaporator coils 40, which form a portion of the ice cube freezing mechanism 25. The coils 40 feed into a return suction line, which is connected to the suction side of the compressor 20. The refrigerant is compressed by the compressor 20 to a high pressure and temperature and is discharged through a discharge line into the condenser 22, which condenses the hot gas back into a liquid. A hot gas bypass line is connected from the discharge line through a normally closed solenoid valve to the evaporator coils.

During a freezing cycle, the refrigeration system operates normally and, as water flows by gravity downwardly over the supporting member 34, the cooling effect provided by the low pressure refrigerant passing through the evaporator coils chills the supporting member 34, causing the water passing downwardly thereover to freeze At a predetermined point, the normally closed solenoid valve is actuated, thereby permitting hot gas to flow directly from the compressor 20 through the hot gas bypass line and into the evaporator coils 40 This frees the formed ice from the supporting member 34 and the vanes 69.

The refrigeration system of the present invention has been designed to remove 75,000 BTU/day with an inlet water temperature of 50° F. and a condensing temperature of 105° F. With these design parameters, and using R-22 refrigerant, ice machine 10 can produce approximately 330 pounds of ice per day.

Figure 14:
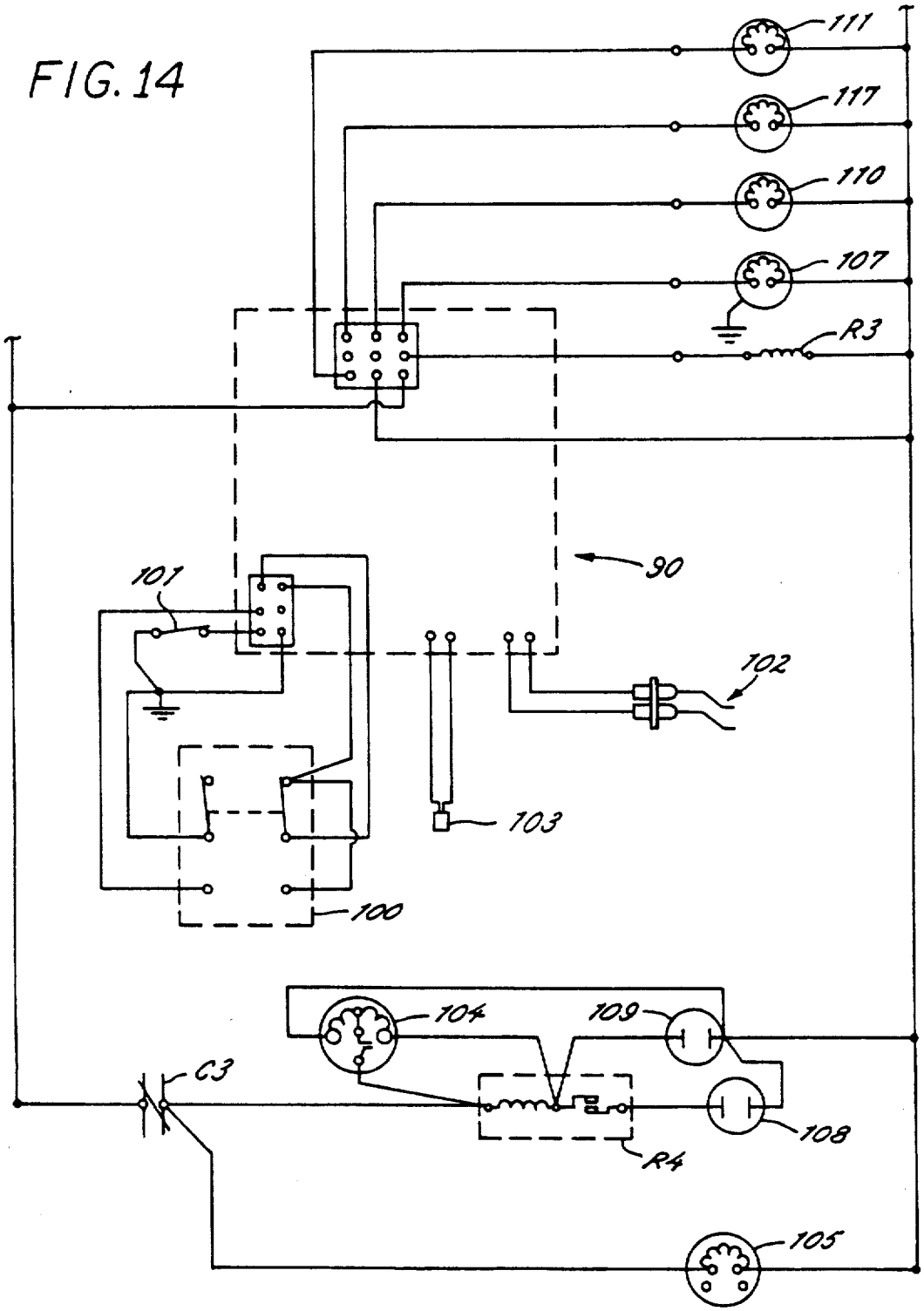
FIG. 14 is a schematic view of a preferred control system.

The control system 90 for the ice machine is illustrated schematically in FIG. 14, and the operation of the ice machine 10 is best understood with reference to this figure. The ice machine is preferably powered by a standard 115 volt A.C. power supply and is conventionally provided with an on/off switch 100. With switch 100 closed, power is supplied to normally closed bin level switch 101, which may be a thermostat or a low voltage magnetic proximity switch, and which closes when the ice in the storage bin drops below a predetermined level on initial start-up of the ice machine 10, the dump valve 117 is energized and remains so for approximately 45 seconds, draining the sump to ensure that the ice making cycle begins with fresh water. Contact C3 is then closed by relay R3, energizing relay R4 and associated start and run capacitors 108 and 109, thus energizing compressor motor 104 and fan motor 105, triggering the start of an ice making cycle.

When the refrigeration system initially begins its freeze cycle, a makeup water solenoid is energized, and the coil 110 of gear motor 70 and hot gas valve 111 are de-energized. Water will continue to fill the sump 55 until a normally open fill switch closes. The water fill switch may be actuated by a float, or may consist of an electronic probe. In this way, the makeup water solenoid is de-energized, stopping the flow of water to the sump. As the refrigerant to cycles, the refrigerant and the evaporator coils 40 cool the vane 69 in freezing chamber 46. At this point the water pump 107 begins to pump water over the supporting member 34 and through the ice forming chamber 46. As this water cools, it freezes to form ice, and since this ice is being formed from circulating water, it has a high degree of clarity.

As ice builds out from the supporting member 34, the water flowing over the formed ice will contact a sensor probe 102, completing the sensor circuit. A preferred sensor is disclosed in U.S. Pat. No. 4,480,441, which is assigned to The Manitowoc Company. When the control 90 senses that this sensor circuit is closed for seven continuous seconds, a four minute time delay is started. Thereafter, the harvest cycle is initiated.

During the harvest cycle, the hot gas valve 111 is energized while the water pump 107 is de-energized for the entire harvest cycle. The dump solenoid 117 is energized for a 45 second time period, and at the conclusion of this period, the dump solenoid 117 is de-energized for the remainder of the harvest cycle. Energizing the dump valve solenoid 111 removes excess water from the sump, so that the next freezing cycle begins with fresh water; energizing in the hot gas solenoid valve causes the gas from the compressor to bypass the condensor 22 and to flow directly to the evaporator coils. The hot gas in the evaporator coils warms supporting member 34 and vanes 69, which loosens the ice therefrom to allow for easy withdrawal of the conveyor 35 from the freezing chamber 46. In the event the total harvest time is less than 45 seconds, the dump valve solenoid 117 is de-energized after the formed ice is harvested.

The gear motor 110 is energized after the hot gas solenoid valve 111 has been energized. As the hot gas heats the evaporator, the gear motor will attempt to turn the conveyor. The gear motor is preferably designed to remain in a stalled condition until the ice is loosened from the supporting member 34 and is no longer adhered thereto. Once the ice is loosened, the torque of the stalled motor is sufficient to turn first wheel 37 in a clockwise direction, as viewed in FIGS. 2 and 4. Driving first wheel 37 clockwise withdraws that portion of the conveyor 35 forming a part of the ice forming mold through the upper end of the freezing chamber 46. As that portion of the conveyor is withdrawn, the leading edge engages projecting paddles 74 extending outwardly from first wheel 37. As the links 62 and flights 64 of the conveyor rotate about the first wheel 37, paddles push the formed ice onto ramp 80, and into the ice storage bin.

The bin level switch 101 is momentarily interrupted as the ice is removed from supporting member 34. Once this interruption occurs, a lock-out timer ensures that the gear motor 110 and the hot gas valve 111 remain energized. After a short period of time, for example approximately 11 seconds, the switch 101 is again electronically monitored to determine if the circuit thereacross is open or closed. If the switch 101 is closed, the freeze cycle is repeated and refrigerant again passes through the condenser 22 to begin cooling the evaporator coils 40.

Those skilled in this art will appreciate that the control system of the present invention can be modified to include diagnostics which monitor the operation of the ice machine 10. For example, the compressor discharge temperature can be sensed by a probe 103 as shown in FIG. 14. Thus, during the freeze or harvest cycle, if the discharge line temperature exceeds a predetermined temperature, such as 260° F., for a period of time, the control system can be designed to disable the machine so that damage to the various components can be avoided. Likewise, if the discharge temperature were to fall below a predetermined temperature, such as 85° F., for a period of time during the harvest cycle, the control system can be designed to disable the machine, in this way stopping the harvest cycle until the control system is reset.

Figure 10:
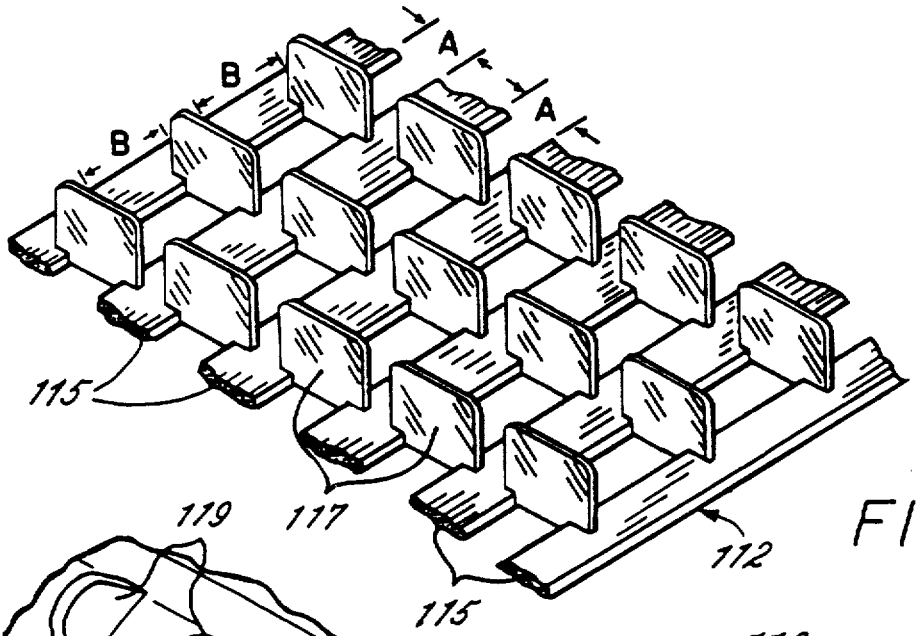
FIG. 10 is a perspective view of another embodiment of the conveyor of the present invention.

An alternative embodiment of the conveyor of the ice making system is shown in FIG. 10. This embodiment differs from that shown in FIG. 8 in that the conveyor 112 is made up of one or more belts 115, which are arranged in spaced relation, and which are interconnected by a plurality of fingers 117. The belts are preferably separated by a predetermined distance A, as best shown in FIG. 10, and the fingers are arranged to project outwardly therefrom. Furthermore, each row of fingers 117 is spaced a predetermined distance B from each adjacent row.

Figure 11:
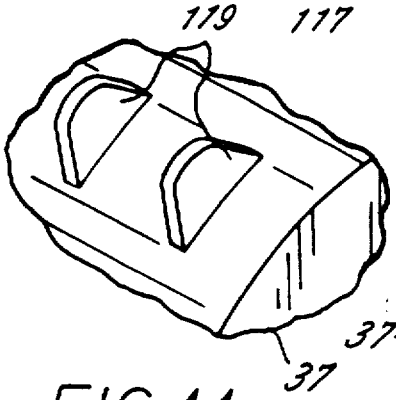
FIG. 11 is an exploded perspective view of a harvesting pulley having outwardly-extending projections useful with the conveyor shown in FIG. 10.
Figure 12:
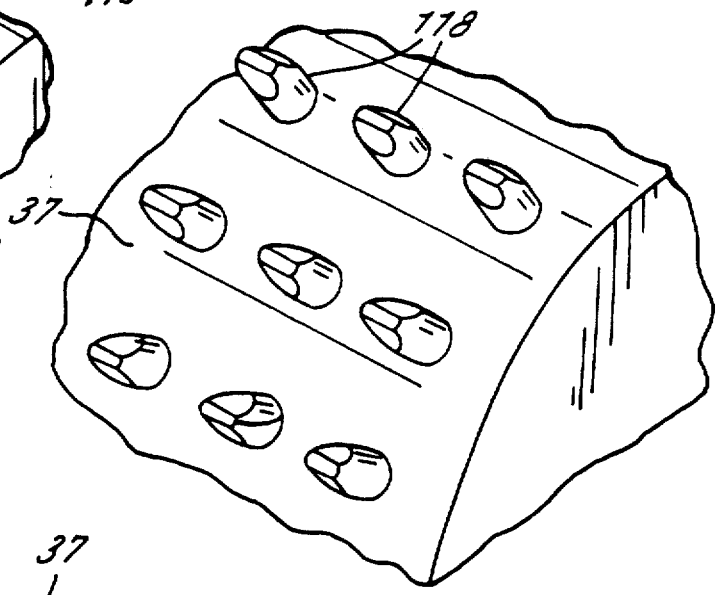
FIG. 12 is a second, preferred embodiment of the harvesting pulley having outwardly-extending projections.

When this alternative conveyor is disposed in the ice forming chamber 46, the fingers adjacent the supporting member 34 are separated by vanes as described above. The fingers and vanes thus form a lattice structure comprising a plurality of individual ice forming cells. As the conveyor 112 is withdrawn from the ice forming chamber, ice which is formed in these cells is ejected therefrom by pin-like projections 118 on an alternative first wheel as shown in FIG. 12, or by projections 119 having a rounded profile, as shown in FIG. 11. Both the pin-like projections 118 and the rounded projections 119 are adapted to fit between the belts and fingers of conveyor 112. In all other respects, the operation of an ice machine incorporating a conveyor consisting of belts and fingers is identical to that illustrated in FIGS. 2 and 5.

Figure 13:
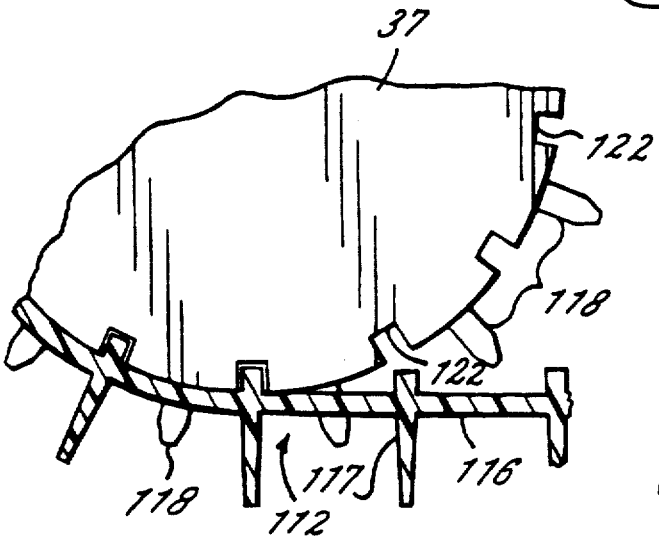
FIG. 13 is a cross section of an alternative embodiment of the harvesting pulley and belt conveyor of the present invention with guides on the conveyor and complementary notches on the harvesting pulley to ensure proper registration therebetween.

In a still further embodiment of first wheel 37, and as illustrated in FIG. 13, the surface 120 of the wheel can be scored with axial notches 122 which are evenly spaced to accept complementary, inwardly extending guides 125 associated with the fingers 117 of the conveyor 112. In this way, the notches and guides cooperate to prevent the conveyor from slipping on the first wheel and also ensure that the projections 118 will be in proper alignment with the conveyor 112.

Those skilled in the art will appreciate that the present invention can encompass many variations. For example, the size and capacity of ice machine 10, including the components thereof, can be scaled upwardly or downwardly to provide the desired ice making capacity and speed. As a further example, those skilled in the art will appreciate that the control system illustrated in FIG. 14 could be replaced by cams attached directly to drive belt 71, or a different control arrangement could be used to actuate switches, counters, or the like.

We claim as our invention:

1. An ice machine comprising, in combination, supporting means for forming a chamber having a side wall including top and bottom portions, said top portion being disposed vertically above said bottom portion, an endless conveyor having a plurality of outwardly extending fingers, a portion of said conveyor and said side wall defining an ice forming mold disposed within said chamber, said mold being divided into a plurality of cube cells, a sump underlying said mold, means for selectively delivering water from said sump to the top of said mold so that the water will flow downwardly through said mold and into said cells, refrigeration means for freezing water within said cells of said mold, and means for harvesting the formed ice, said ice harvesting means including means operably coupled with said conveyor for withdrawing the conveyor and the ice formed thereon from said chamber and means for detaching said ice from said conveyor.

2. The combination of claim 1 wherein the endless conveyor comprises a chain of links which carry substantially linear flights and said harvesting means comprises a wheel having a plurality of paddles extending radially therefrom, said paddles urging the formed ice from said links when the conveyor rotates about said wheel.

3. The combination of claim 2 wherein a plurality of vanes extend upwardly from the side wall between adjacent fingers of said conveyor whereby said fingers and vanes define said cube cells spaced along the length of the ice forming mold.

4. The combination of claim 3 wherein the harvesting means includes means for heating said side wall to release the formed ice therefrom to facilitate the withdrawal of the conveyor from said chamber.

5. An ice machine comprising, in combination, a housing forming a chamber, an ice forming mechanism disposed within said chamber, said mechanism including supporting means having a side wall with top and bottom portions, said top portion being disposed vertically above said bottom portion, an endless conveyor having a plurality of outwardly extending fingers, a portion of said conveyor and said side wall defining an ice forming mold, said mold being divided into a plurality of cube cells, a sump underlying said mold, means for selectively delivering water from said sump to the top of said mold so that said water will flow downwardly through said mold and into said cells, refrigeration means for freezing water within said cells of said mold, and means for harvesting the formed ice, said ice harvesting means including means operably coupled with said conveyor for guiding the ice formed on said conveyor upwardly with respect to said sidewall, and means for detaching said ice from said conveyor.

6. The combination of claim 5 wherein the endless conveyor comprises a chain of links which carry substantially linear flights, each flight having a plurality of said fingers, and wherein a plurality of vane extend upwardly from the sidewall of said ice forming mechanism between adjacent fingers on each flight, whereby said fingers and vanes define said cube cells spaced evenly along the length of the ice forming mold.

7. An ice cube machine including, in combination, an ice forming mechanism and an ice cube storage bin spaced therefrom, said ice cube freezing mechanism comprising a supporting surface for forming a chamber having a side wall including top and bottom portions, said top portion being disposed vertically above said bottom portion, and an endless conveyor having a plurality of outwardly extending fingers, a portion of said conveyor and said sidewall defining an inclined ice forming mold, said mold being divided into a plurality of cube cells, a sump underlying said mold, means for selectively delivering water from said sump to the top of said mold so that the water will flow downwardly through said mold and into said cells, refrigeration means for freezing water within the cells of said mold, and means for harvesting the formed ice, said ice harvesting means including means operably coupled with said conveyor for moving the conveyor upwardly with respect to the sidewall and means for detaching the iced formed thereon and for directing said ice to the ice storage bin.

8. An ice machine comprising, in combination, supporting means for forming a chamber having a side wall including top and bottom portions, said top portion being disposed vertically above said bottom portion, an endless conveyor comprising a plurality of belts interconnected by fingers aligned in rows in spaced apart relation, a portion of said conveyor and said side wall defining an ice forming mold disposed within said chamber, said mold being divided into a plurality of cube cells, a sump underlying said mold, means for selectively delivering water from said sump to the top of said mold so that the water will flow downwardly through said mold and into said cells, refrigeration means for freezing water within said cells of said mold, and means for harvesting the formed ice, said ice harvesting means including means operably coupled with said conveyor for withdrawing the conveyor and the ice formed thereon from said chamber and means for detaching said ice from said conveyor comprising a wheel having a plurality of projections extending radially therefrom, said projections urging the formed ice from the belts and fingers of said conveyor when the conveyor rotates about said wheel.

9. The combination of claim 8 wherein a plurality of vanes extend upwardly from the sidewall of said ice forming mechanism between adjacent fingers of said conveyor to define a lattice structure, whereby said fingers and vanes define said cube cells spaced evenly along the length of the ice forming mold.

* * * * *